US010233816B2

(12) United States Patent
Honda et al.

(10) Patent No.: US 10,233,816 B2
(45) Date of Patent: Mar. 19, 2019

(54) OIL JET

(71) Applicants: TOYOTA JIDOSHA KABUSHIKI KAISHA, Toyota-shi, Aichi-ken (JP); TAIHO KOGYO CO., LTD., Toyota-shi, Aichi-ken (JP)

(72) Inventors: Akihiro Honda, Susono (JP); Motoichi Murakami, Gotenba (JP); Masahiro Kawahara, Toyota (JP); Norio Imai, Toyota (JP)

(73) Assignees: Toyota Jidosha Kabushiki Kaisha, Toyota-shi, Aichi-ken (JP); Taiho Kogyo Co., Ltd., Toyota-shi, Aichi-ken (JP)

( * ) Notice: Subject to any disclaimer, the term of this patent is extended or adjusted under 35 U.S.C. 154(b) by 92 days.

(21) Appl. No.: 14/910,857

(22) PCT Filed: Jun. 9, 2014

(86) PCT No.: PCT/JP2014/065216

§ 371 (c)(1),
(2) Date: Feb. 8, 2016

(87) PCT Pub. No.: WO2015/019697

PCT Pub. Date: Feb. 12, 2015

(65) Prior Publication Data

US 2016/0186642 A1 Jun. 30, 2016

(30) Foreign Application Priority Data

Aug. 9, 2013 (JP) ..... 2013-166806

(51) Int. Cl.
*F01P 3/08* (2006.01)
*F01M 1/08* (2006.01)

(52) U.S. Cl.
CPC ..... *F01P 3/08* (2013.01); *F01M 1/08* (2013.01); *F01M 2001/083* (2013.01)

(58) Field of Classification Search
CPC ..... F01M 2001/083; F01M 1/08; F01P 3/08; F02F 3/16; F02F 3/22; F02F 3/225
See application file for complete search history.

(56) References Cited

U.S. PATENT DOCUMENTS 4,114,571 A * 9/1978 Ruf ..... F01M 1/08 123/196 AB
4,206,726 A * 6/1980 Johnson, Jr. ..... F01P 3/08 123/41.35

(Continued)

FOREIGN PATENT DOCUMENTS

JP 6-42346 2/1994
JP 8-326535 12/1996

(Continued)

*Primary Examiner* — Erick Solis
(74) *Attorney, Agent, or Firm* — Finnegan, Henderson, Farabow, Garrett & Dunner, LLP

(57) ABSTRACT

A body of an oil jet is provided with: an oil supply port; a cylinder; and an oil injection port. A piston valve is accommodated in the cylinder. The piston valve forms in the cylinder a differential pressure room which is a closed compartment. In the piston valve, an orifice which makes the differential pressure room being communicated with a side of the oil supply port is formed. The piston valve is biased toward a position at which the oil injection port is closed by a spring. A first oil injection nozzle is connected to the oil injection port. A leak hole which allows oil to be leaked outside of the cylinder from the differential pressure room is open at the side surface of the cylinder. Further, a second oil injection nozzle is connected to the leak hole.

3 Claims, 2 Drawing Sheets

(56) References Cited

U.S. PATENT DOCUMENTS 4,276,960 A * 7/1981 Webb ..... F04C 29/0014 137/115.14
4,508,065 A * 4/1985 Suchdev ..... F01P 3/08 123/41.35
4,667,630 A * 5/1987 Sasaki ..... F01P 3/08 123/254
5,188,070 A * 2/1993 Otsuka ..... B60W 10/02 477/167
5,517,959 A * 5/1996 Kato ..... F01M 1/02 123/196 AB
5,819,692 A * 10/1998 Schafer ..... F01P 3/08 123/41.35
5,915,345 A * 6/1999 Kling ..... F01P 3/08 123/41.35
6,488,479 B1 * 12/2002 Berger ..... F01M 1/16 123/196 R
6,550,698 B2 * 4/2003 Ness ..... F01P 3/08 239/132
6,895,905 B2 * 5/2005 Bontaz ..... F01P 3/08 123/41.35
7,071,436 B2 * 7/2006 Coates ..... H01H 27/00 200/330
7,360,510 B2 * 4/2008 Bontaz ..... F01P 3/08 123/41.35
8,001,944 B2 * 8/2011 Yagyu ..... B60R 25/045 123/179.3
8,707,927 B2 * 4/2014 Hazelton ..... F01M 1/08 123/196 A
9,010,282 B2 * 4/2015 Yamaguchi ..... F01P 3/08 123/193.6
9,488,149 B2 * 11/2016 Koenen ..... B60K 28/04
2003/0005893 A1 * 1/2003 Bontaz ..... F01P 3/08 123/41.35
2004/0040520 A1 * 3/2004 Bontaz ..... F01P 3/08 123/41.35
2005/0072476 A1 * 4/2005 Neto ..... F01P 3/08 137/539
2007/0056792 A1 * 3/2007 Hildebrand ..... B60R 25/045 180/287
2007/0084430 A1 * 4/2007 Hatayama ..... F02D 41/009 123/179.14
2013/0019834 A1 * 1/2013 Hazelton ..... F01P 3/08 123/196 R
2014/0091161 A1 4/2014 Yamaguchi et al.
2015/0027388 A1 * 1/2015 Honda ..... F01M 1/08 123/41.35
2015/0167617 A1 * 6/2015 Fujita ..... F02N 11/0859 701/113
2015/0361941 A1 * 12/2015 Du ..... F02N 11/108 702/33
2016/0071332 A1 * 3/2016 MacFarlane ..... B60K 35/00 701/29.1
2016/0201633 A1 * 7/2016 Quinteros ..... F02N 11/084 477/111
2016/0290264 A1 * 10/2016 Oda ..... F02D 41/042
2016/0297415 A1 * 10/2016 Kato ..... B60W 30/18118
2016/0298559 A1 * 10/2016 Matsushita ..... F02N 11/0862
2016/0362110 A1 * 12/2016 Martini ..... B60W 10/30
2017/0067404 A1 * 3/2017 Yonan ..... F02D 41/22

FOREIGN PATENT DOCUMENTS

JP 2011-12650 1/2011
JP 2011-64155 3/2011
JP 2014-70611 4/2014

* cited by examiner

[Fig. 1]
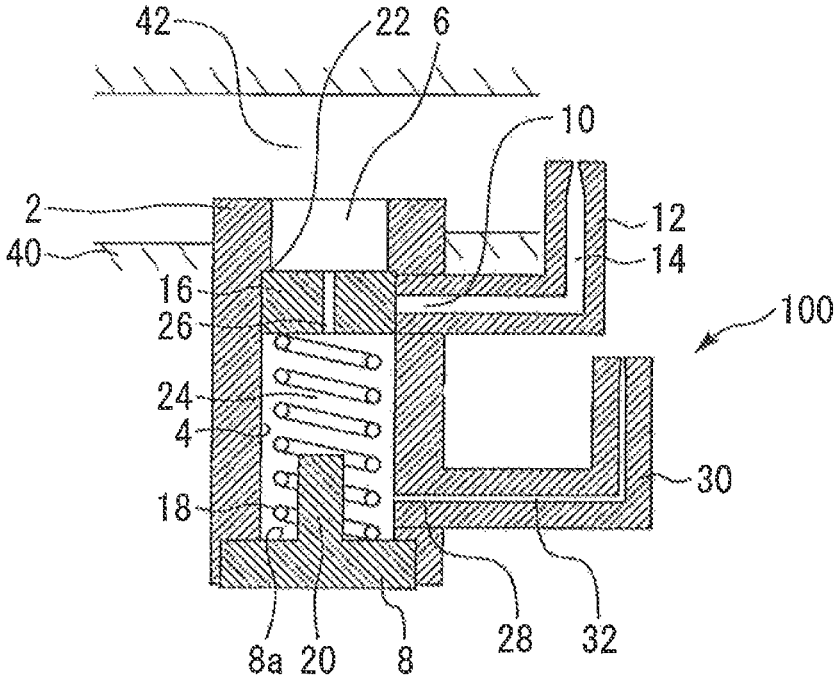
[Fig. 2]
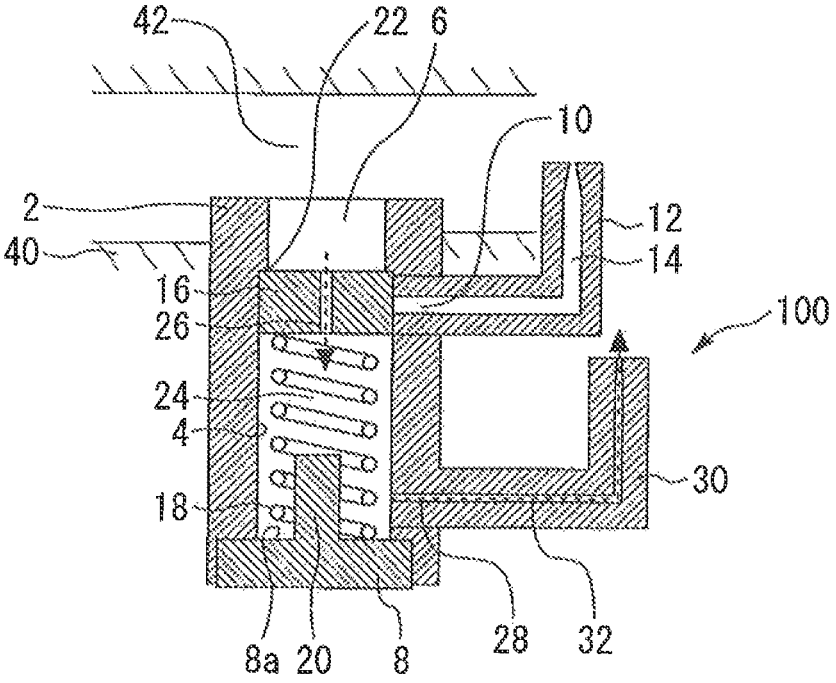

[Fig. 3]
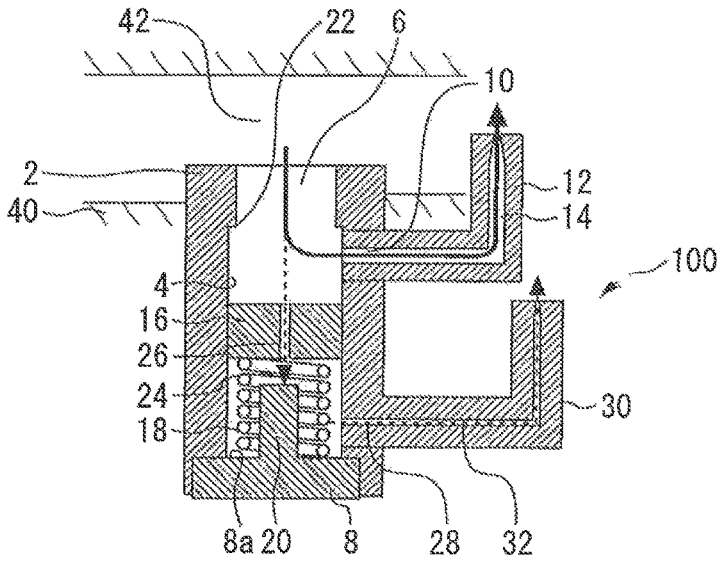
[Fig. 4]
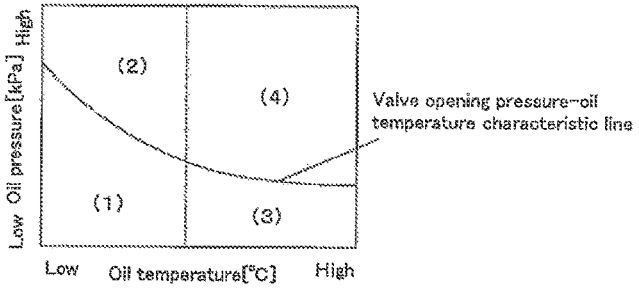
[Fig. 5]
| Operational range | Oil temp | Engine speed | Leak amount | Oil P *1 | Valve opening P | Oil P (Oil passage) | Injection |
|---|---|---|---|---|---|---|---|
| (1) | Low | Low | Small | High | High | Low | No |
| (2) | Low | High | Small | High | High | High *2 | Yes |
| (3) | High | Low | Large | Low | Low | Low *3 | No |
| (4) | High | High | Large | Low | Low | High | Yes |
*1:Differential pressure room, *2:Higher than valve opening pressure,
*3:Lower than valve opening pressure

OIL JET

CROSS-REFERENCE TO RELATED APPLICATIONS

This application is a national phase application of International Application No. PCT/JP2014/065216, filed Jun. 9, 2014, and claims the priority of Japanese Application No. 2013-166806, filed Aug. 9, 2013, the content of both of which is incorporated herein by reference.

TECHNICAL FIELD

The present invention relates to an oil jet that is used for cooling a piston of an internal combustion engine.

BACKGROUND

In a cylinder block of an internal combustion engine, an oil passage through which oil that is pressurized flows is formed. An oil jet is an apparatus which injects oil that is supplied from the oil passage, to a piston or a gap between the piston and a cylinder bore, and which thereby cools the piston that is in a high temperature state. A conventional oil jet generally used has a mechanism for opening and closing its valve in accordance with oil pressure. Specifically, a body of the valve is biased in a direction acting against the oil pressure by a spring, and the valve is configured to open as a result of the body of the valve separating from a valve seat when a force of oil pressure acting on the body of the valve exceeds the force of the spring. The oil pressure increases with an increase in engine speed, whereas because the temperature of the piston increases with an increase in the engine speed, the above described mechanism can cool the piston by injecting oil in a situation in which the temperature of the piston becomes high and prevent the piston from being excessively cooled by stopping the injection of oil in a situation in which the temperature of the piston is not high.

An oil jet disclosed in the following Patent Literature 1 also has a mechanism for opening and closing its valve in accordance with oil pressure. This oil jet has a further mechanism for changing the injection amount of oil in accordance with oil temperature. The mechanism corresponds to a throttle member that is disposed upstream of the valve. A plurality of throttle holes are formed in the throttle member. Fluid resistance of oil acts when passing through these throttle holes, and the magnitude thereof increases with an increase in the viscosity of the oil. Because of this, the flow rate of the oil passing through the throttle holes becomes smaller when the temperature of the oil is low and the viscosity of the oil is high, whereas the flow rate of the oil passing through the throttle holes becomes larger when the temperature of the oil is high and the viscosity of the oil is low. According to such mechanism, when the valve is opened in association with an increase in oil pressure, the injection amount of oil is suppressed because of low oil temperature if it is during the cold condition immediately after an engine start up, whereas the injection amount of oil is increased in association with an increase in oil temperature if it is after completion of a warm up.

In addition, another oil jet is proposed which has a mechanism for opening and closing its valve in accordance with oil temperature as well as a mechanism for opening and closing the valve in accordance with oil pressure. An oil jet disclosed in the following Patent Literature 2 has a first mechanism for opening and closing its valve with a normal spring and a second mechanism for opening and closing its valve with a spring made of a shape-memory alloy. According to the first mechanism having the normal spring, the valve is opened when a force of oil pressure acting on a body of the valve exceeds the force of the spring. On the other hand, according to the second mechanism having the spring made of a shape-memory alloy, the valve becomes closed during the cold condition hi which the spring is compressed, whereas the valve becomes opened during the warm condition in which the spring is restored to expand. With such mechanisms, both valves are opened to inject oil only when the oil pressure is high and the oil temperature is high.

Alternatively, an oil jet, as with, for example, an oil jet disclosed in the following Patent Literature 3, is proposed which can electrically control the execution and stopping of oil injection by driving a body of its valve using a solenoid. Including the above described literature, the applicant is aware of the following literature as literature related to the present invention.

CITATION LIST

Patent Literature

Patent Literature 1: Japanese Laid-open Patent Application Publication No. 2011-064155

Patent Literature 2: Japanese Laid-open Patent Application Publication No. 2011-012650

Patent Literature 3: Japanese Laid-open Patent Application Publication No. Hei 06-042346

SUMMARY OF INVENTION

Technical Problem

Each of the oil jets disclosed in Patent Literature 1 and 2 is configured such that the operational state is changed depending on oil temperature as well as oil pressure. The oil temperature is closely related to the temperature state of the piston as well as the oil pressure, and therefore, according to the configuration in which the operational state of the oil jet is changed also depending on the oil temperature, it is conceivable that the piston could be cooled more properly with the injection of oil, compared with a general oil jet by which its valve is opened and closed simply in accordance with the oil pressure.

However, each of the oil jets disclosed in Patent Literature 1 and 2 is problematic as described later.

Since the oil jet disclosed in Patent Literature 1 includes the throttle member disposed in a flow passage of oil, pressure loss is produced when oil passes through the throttle member. Although the pressure loss produced becomes smaller if the viscosity of oil decreases as a result of an increase in the oil temperature, the pressure loss is larger than that of an oil jet which does not include the throttle member. The amount of oil injected to the piston at the time of high temperature is decreased by an amount corresponding to the pressure loss. Further, since the injection amount of oil is suppressed until the oil temperature is sufficiently increased even if the oil pressure rises, there is a concern that in a case like when the internal combustion engine during the cold condition is operated at high engine speed, a sufficient amount of oil may not be injected even though the temperature of the piston is high.

According to the oil jet disclosed in Patent Literature 2, oil is not injected until the valves of both of the first mechanism for opening and closing its valve with the normal spring and the second mechanism for opening and closing its valve with the spring made of a shape-memory alloy is opened. Because of this, in a case in which the oil temperature is low but the oil pressure is high, such as a case in which the internal combustion during the cold condition is operated at high engine speed, the oil can not be injected in spite of a thermally severe condition due to an increase in the piston temperature.

The problem described so far can be solved by changing, in accordance with the oil temperature, a valve opening pressure when a valve is opened. That is to say, a problem that each of the oil jets disclosed in Patent Literature 1 and 2 has would not occur, if the valve opening pressure could increase when the oil temperature is low, and if the valve opening pressure could decrease with an increase in the oil temperature. However, it is preferable that the valve opening pressure be self regulated mechanically instead of electrically operating the opening and closing of the valve as in the oil jet disclosed in Patent Literature 3. This is because it has an advantage in terms of reliability and cost. Moreover, in order to ensure that the valve opening pressure can be self-regulated mechanically and smoothly in accordance with the oil temperature and that injection of oil by an oil injection nozzle can be stably performed, it is preferable that a configuration be adopted such that the oil that is supplied inside the oil jet can be effectively utilized.

The present invention has been conceived in view of the above described problem, and an object of the present invention is to provide an oil jet in which a valve opening pressure is self-regulated mechanically in accordance with oil temperature and in which the oil that is supplied is effectively utilized.

Solution to Problem

An oil jet according to the present invention includes at least a body, a piston valve, a spring, a first oil injection nozzle and a second oil injection nozzle. The body is a main body part of the oil jet attached to a cylinder block of an internal combustion engine, and has an oil supply port, a cylinder and an oil injection port. The oil supply port is formed so as to open into an oil passage in the cylinder block in a state in which the body is attached to the cylinder block. One end of the cylinder is communicated with the oil supply port, and another end thereof is closed. The oil injection port opens on a side surface of the cylinder. The piston valve is accommodated in the cylinder and forms a closed compartment in the cylinder. In the piston valve, an orifice which makes the closed compartment being communicated with a side of the oil supply port is formed. The spring biases the piston valve toward a position at which the oil injection port is closed. The first oil injection nozzle is connected to the oil injection port and is for fixing a direction of injection of oil. Further, in the oil jet according to the present invention, a leak hole which allows oil to be leaked outside of the cylinder from the closed compartment is open at the side surface of the cylinder. Furthermore, the oil jet according to the present invention includes the second oil injection nozzle that is connected to the leak hole and that is for fixing a direction of injection of oil.

According to the above described configuration which the oil jet in the present invention includes, the oil injection port is opened and closed by the piston valve. On the piston valve, the pressure of oil flowing through the oil passage in the cylinder block acts, and at the same time, the pressure of oil in the closed compartment and a biasing force by the spring act in a direction opposite to this. Further, when a force of the oil pressure in the oil passage acting on the piston valve has become greater than the total force of a force of the oil pressure in the closed compartment acting on the piston valve and the biasing force of the spring, the piston valve is pushed by the oil supplied from the oil passage to move from a position Which covers the oil injection port. This allows the piston valve to be in the opened state so that the oil injection port is communicated with the oil supply port, and allows oil to be supplied to the oil injection port so that oil injection from the first oil injection nozzle is achieved.

The oil pressure in the closed compartment varies in accordance with a relation between the flow rate of oil flowing into the closed compartment through the orifice and the flow rate of oil leaking from the closed compartment through the leak hole. In the oil jet according to the present invention, there is a difference between the orifice and the leak hole in a factor for determining their flow rates. In the orifice in which a relation between flow rate and pressure is based on Bernoulli's theorem, oil density determines the flow rate. More specifically, the flow rate of the oil passing through the orifice to flow into the closed compartment from the oil injection port side is inversely proportional to the one-second power of the oil density. On the other hand, in the leak hole in which flow rate is determined based on Hagen-Poiseuille law, oil viscosity determines the flow rate. More specifically, the flow rate of the oil passing through the leak hole to leak outside the body from the closed compartment in the cylinder is inversely proportional to the oil viscosity. Here, an important thing is that there is a large difference in the sensitivities thereof with respect to the oil temperature between the oil density and the oil viscosity. The oil density changes little with respect to a change in the oil temperature, and the oil density can be recognized as being nearly constant in a normal temperature range of oil in an internal combustion engine. In contrast to this, the oil viscosity changes quite greatly with respect to a change in the oil temperature. Although depending on oil types, the oil viscosity during the cold time is more than ten times the oil viscosity after warm up. Because of this, when compared at the same pressure in the closed compartment, although the flow rate of the oil which flows into the closed compartment from the orifice does not change greatly depending on the oil temperature, the flow rate of the oil which is leaked from the leak hole increases with an increase in the oil temperature. As the flow rate of the oil which is leaked from the leak hole becomes larger, the oil pressure in the closed compartment becomes lower.

Since a biasing force of the spring is constant, an oil pressure in the oil passage that is required to move the piston valve, that is to say, a valve opening pressure is determined depending on the oil pressure in the closed compartment. In a situation in which the oil temperature is high, such as a time after completion of warm up, oil is easy to be leaked from the closed compartment because the oil viscosity is low, and as a result, the valve opening pressure becomes low because the pressure in the closed compartment becomes low. On the other hand, in a situation in which the oil temperature is low, such as the cold time, oil is hard to be leaked from the closed compartment because the oil viscosity is high, and as a result, the valve opening pressure becomes high because the pressure in the closed compartment becomes high. In fact, according to the above described configuration which the oil jet of the present invention includes, the valve opening pressure is self regulated mechanically so that the valve opening pressure becomes lower with an increase in the oil temperature and the valve opening pressure becomes higher with a decrease in the oil temperature.

Moreover, as described above, there is a flow of oil that leaks from the closed compartment through the leak hole, regardless of opening and closing the piston valve. Therefore, according to the oil jet in the present invention, injection of the oil from the second oil injection nozzle is completed by use of oil that leaks through the leak hole, regardless of whether the piston valve is open or closed.

Further, the other end of the cylinder that is closed may be positioned at a lower side in a direction of gravitational force in the cylinder. Furthermore, a distal end of the first oil injection nozzle may be directed to a back side of a piston that reciprocates in a cylinder of the internal combustion engine, and a distal end of the second oil injection nozzle may be directed to a cylinder bore of the internal combustion engine.

As described above, the oil jet according to the present invention can self-regulate a valve opening pressure mechanically in accordance with oil temperature and in which the oil that is supplied is effectively utilized.

BRIEF DESCRIPTION OF DRAWINGS

FIG. 1 is a longitudinal cross-sectional view which represents a configuration of an oil jet according to a first embodiment of the present invention;

FIG. 2 is a longitudinal cross-sectional view which exemplarily represents a state at the time of closing of the oil jet according to the first embodiment of the present invention;

FIG. 3 is a longitudinal cross-sectional view which exemplarily represents a state at the time of opening of the oil jet according to the first embodiment of the present invention;

FIG. 4 is a graph which represents characteristics of a valve opening pressure with respect to oil temperature of the oil jet according to the first embodiment of the present invention; and FIG. 5 is a table collectively showing operational states in the respective ranges in FIG. 4.

DESCRIPTION OF EMBODIMENT

First Embodiment

Hereinafter, a first embodiment of the present invention will be described with reference to Figures.

A configuration of an oil jet according to the first embodiment of the present invention can be explained using FIG. 1. As shown by the longitudinal sectional view of FIG. 1, an oil jet 100 according to the present embodiment includes a body 2 attached to a cylinder block 40 of an internal combustion engine. The attachment of the body 2 to the cylinder block 40 can be made, for example, via a plate (not shown in the drawings). In the cylinder block 40, an oil passage 42 through which oil pressurized by an oil pump (not shown in the drawings) flows is formed. Since the oil pump is driven by a power received from a crankshaft of the internal combustion engine, the oil pressure inside the oil passage 42 is low when the engine speed is low, and the oil pressure inside the oil passage 42 increases with an increase in the engine speed. In the body 2, an oil supply port 6 which opens into this oil passage 42 is formed.

In the body 2, a cylinder 4 an inlet of which is the oil supply port 6 is formed. Although the cylinder 4 is formed so as to penetrate the body 2, the outlet thereof is covered by a plug 8. More specifically, the plug 8 constitutes the bottom portion of the cylinder 4. In this way, a room (a closed compartment 24 described later), one end of which is open and the other end of which is closed, is formed in the cylinder 4. An oil injection port 10 the diameter of which is smaller than that of the cylinder 4 is open on a side surface of the cylinder 4 and in the vicinity of the inlet thereof. A first oil injection nozzle 12 is joined to the body 2 by brazing or the like, and a first oil injection passage 14 that is formed inside the first oil injection nozzle 12 is communicated with the oil injection port 10. The distal end portion of the first oil injection passage 14 is narrowed with a decreasing diameter toward the outlet thereof, in order to increase the flow velocity of the oil that flows through the first oil injection passage 14. The distal end of the first oil injection nozzle 12 is directed to the back surface of a piston of the internal combustion engine. Note that, although only one first oil injection nozzle 12 is shown in FIG. 1, a plurality of first oil injection nozzles 12 can alternatively be attached to the body 2 by forming a plurality of oil injection ports 10 in the circumferential direction of the cylinder 4.

In the cylinder 4, a piston valve 16 is accommodated so as to be able to reciprocate along the wall surface of the cylinder 4. In addition, a spring 18 is accommodated in the cylinder 4. The spring 18 is a compression coil spring and disposed between the piston valve 16 and the bottom surface (a reference surface 8*a* of the plug 8) of the cylinder 4. Further, a stopper 20 is integrally formed with the plug 8. The stopper 20 has a circular cylindrical shape and is protruded into the cylinder 4 from the bottom part of the cylinder 4 (from the reference surface 8*a* of the plug 8) inside the spring 18.

The moving range of the piston valve 16 is specified due to the fact that movement toward the lower side is limited by the stopper 20 and movement toward the upper side is limited by a stepped portion 22 existing between the oil supply port 6 and the cylinder 4. The length of the spring 18 is adjusted such that the piston valve 16 comes to a position to hump into the stepped portion 22 and to cover the oil injection port 10 in a state in which no oil pressure acts on to the piston valve 16. The height of the stopper 20 is set so as not to cover a leak hole 28 described later as a result of the piston valve 16 moving downward.

There is formed inside the cylinder 4, the closed compartment 24 that is surrounded by the piston valve 16 and the side surface and bottom surface of the cylinder 4. There is formed in the piston valve 16, an orifice 26 which makes the closed compartment 24 being communicated with the side of the oil supply port 6. Because of this, in a situation in which the oil jet 100 is attached to the cylinder block 40, the closed compartment 24 is filled up with oil via the orifice 26. In this regard, according to the configuration described later, a differential pressure with respect to the oil pressure in the oil passage 42 is produced concerning the oil pressure in the closed compartment 24. Hereinafter, this closed compartment 24 is referred to as a differential pressure room.

The bottom part of the differential pressure room 24 is formed using the plug 8. The leak hole 28 for leaking the oil in the differential pressure room 24 outside the cylinder 4 is open at the side surface of the cylinder 4. The flow passage sectional area of the leak hole 28 is formed much smaller than the sectional area of the differential pressure room 24. In addition, the flow passage sectional area of the leak hole 28 is formed smaller than the flow passage sectional area of the orifice 26. Forming such leak hole 28 in the body 2 causes oil to be leaked outside the body 2 from the differential pressure room 24, and thereby, the oil pressure in the differential pressure room 24 is decreased. That is to say, a differential pressure is produced between the oil pressure in the oil passage 42 and the oil pressure in the differential pressure room 24.

Moreover, a second oil injection nozzle 30 is joined to the body 2 by brazing or the like, and a second oil injection passage 32 that is formed inside the second oil injection nozzle 30 is communicated with the leak hole 28 (that function also as a second oil injection port). The distal end portion of the second oil injection passage 32 is narrowed with a decreasing diameter toward the outlet thereof, in order to increase the flow velocity of the oil that flows through the second oil injection passage 32. The distal end of the second oil injection nozzle 30 is directed to a cylinder bore of the internal combustion engine. Note that, although only one second oil injection nozzle 30 is shown in FIG. 1, a plurality of second oil injection nozzles 30 can alternatively be attached to the body 2 by forming a plurality of leak holes 28 in the circumferential direction of the cylinder 4.

Furthermore, the closed bottom portion (plug 8) of the cylinder 4 is positioned at the lower side in the direction of gravitational force in the cylinder 4 relative to the position of opening of the leak hole 28. More specifically, the leak hole 28 is communicated with the differential pressure room 24 at the upper side relative to the lowest position (reference surface 8*a* of the plug 8) of the differential pressure room 24 in the vertical direction (gravitational direction). For more details, the leak hole 28 is formed in the side surface of the cylinder 4 at a portion on the upper side relative to the reference surface 8*a* of the plug 8 and on the lower side relative to the distal end of the stopper 20. Note that, provided that the bottom portion (stopper 20) of the cylinder 4 is positioned at the lower side in the direction of gravitational force, it is not required that the central axis direction of the cylinder 4 be exactly identical with the direction of gravitational direction.

Next, the operation of the oil jet 100 according to the present embodiment will be described with reference to FIG. 2 and FIG. 3. Note that FIG. 2 and FIG. 3 show the flow of oil in the oil jet 100 with arrowed lines.

According to the configuration of the oil jet 100 in the present embodiment, the hydraulic pressure of the oil that flows through the oil passage 42 acts on the piston valve 16 from the oil supply port 6 side. In addition, at the same time, the oil pressure in the differential pressure room 24 and a biasing force of the spring 18 act on the piston valve 16 in the opposite direction. The former acts on the piston valve 16 as a force in the valve opening direction, and the latter acts as a force in the valve closing direction. Consequently, if the total force of a force due to the oil pressure in the differential pressure room 24 and a biasing force of the spring 18 is greater than or equal to a force due to the oil pressure in the oil passage 42, the piston valve. 16 is held at a position that covers the oil injection port 10 as shown in the exemplary diagram in FIG. 2. That is to say, the piston valve 16 is maintained in the closed state. However, there is inside the oil jet 100 a flow of oil that leaks from the differential pressure room 24 through the leak hole 28. The supply of the oil into the leak hole 28 in this manner causes the oil to be injected from the second oil injection nozzle 30.

If, on the other hand, a force due to the oil pressure in the oil passage 42 is greater than the total force of a force due to the oil pressure in the differential pressure room 24 and a biasing force of the spring 18, the piston valve 16 is pushed by the oil supplied from the oil passage 42 to move from the position that covers the oil injection port 10 as shown in the exemplary, diagram in FIG. 3. This allows the piston valve 16 to be in the open state so that the oil injection port 10 is communicated with the oil supply port 6, and allows oil to be supplied to the oil injection port 10 so that oil injection by use of the first oil injection nozzle 12 is achieved. In this case also, there is inside the oil jet 100 a flow of oil that leaks from the differential pressure room 24 through the leak hole 28, although the flow is weaker than that at the time of closing the piston valve 16. Therefore, the oil is supplied to the leak hole 28 even after opening of the piston valve 16, and thereby, injection of the oil from the second oil injection nozzle 30 is completed.

Since a biasing force of the spring 18 is constant when the position of the piston valve 16 is constant, an oil pressure in the oil passage 42 that is required to open the piston valve 16 is determined depending on the oil pressure in the differential pressure room 24. The oil pressure in the differential pressure room 24 varies with a relation between the flow rate of the oil which enters into the differential pressure room 24 and the flow rate of the oil which is discharged from the differential pressure room 24. Since the oil flows into the differential pressure room 24 through the orifice 26, the flow rate Q1 thereof is based on Bernoulli's theorem as represented by the following equation 1. More specifically, the flow rate Q1 of the oil passing through the orifice 26 is proportional to the one-second power of the differential pressure between the oil pressure $P_{M/G}$ in the oil passage 42 and the oil pressure PIN in the differential pressure room 24, and inversely proportional to the one-second power of oil density ρ. Concerning the equation 1, "C" denotes a flow coefficient, and "A" denotes the flow passage sectional area of the orifice 26. In further addition to that, the dimensions (for example, the diameter and width of flow path) of the orifice 26 are arranged so that the orifice 26 functions as a flow path that is in accordance with the aforementioned Bernoulli's theorem.

[Equation 1]

$$Q1 = C \times A \times \sqrt{\frac{2(P_{MIG} - P_{IN})}{\rho}} \qquad \text{Equation 1}$$

On the other hand, since the oil is leaked through the leak hole 28 from the differential pressure room 24, the flow rate Q2 thereof is based on Hagen-Poiseuille law as represented by the following equation 2. More specifically, the flow rate Q2 of the oil passing through the leak hole 28 is proportional to the differential pressure between the oil pressure PIN in the differential pressure room 24 and the atmospheric pressure $P_{OUT}$, and inversely proportional to oil viscosity η. Concerning the equation 2, "B" denotes a coefficient. In further addition to that, the dimensions (for example, the diameter and length of flow path) of the leak hole 28 and the second oil injection passage 32 that is communicated therewith are arranged so that they function as flow paths that are in accordance with the aforementioned Hagen-Poiseuille law.

[Equation 2]

$$Q2 = (P_{IN} - P_{OUT}) \times \frac{\pi}{12\eta} \times B \qquad \text{Equation 2}$$

As evidenced from the above described two equations, the flow rate of the oil passing through the orifice 26 is affected by the oil density, whereas the flow rate of the oil passing through the leak hole 28 is affected by the oil viscosity. Although the oil density and the oil viscosity are both affected by the oil temperature, the sensitivities thereof greatly differ from each other. Specifically, the oil density changes little with respect to a change in the oil temperature, and the oil density is nearly constant at a temperature range used during a period from the cold time to a warm-up completion time. In contrast to this, the oil viscosity changes quite greatly with respect to a change in the oil temperature, and the oil viscosity during the cold time is about twenty times as high as the oil viscosity after the warm up.

Due to each characteristic of the oil density and oil viscosity with respect to the oil temperature as above, although the flow rate of the oil which flows into the differential pressure room 24 from the orifice 26 does not change greatly depending on the oil temperature, the flow rate of the oil which is leaked from the leak hole 28 increases with an increase in the oil temperature. As the flow rate of the oil which is leaked from the leak hole 28 becomes larger, the oil pressure in the differential pressure room 24 becomes lower, and thereby, an oil pressure in the oil passage 42 required to open the piston valve 16, that is to say, a valve opening pressure becomes lower. Consequently, in a case in which the oil temperature is high, such as a time after completion of warm up, the valve opening pressure becomes low because the oil is easy to be leaked from the leak hole 28, whereas in a case in which the oil temperature is low, such as the cold time, the valve opening pressure becomes high because the oil is hard to be leaked from the leak hole 28.

FIG. 4 shows a graph that represents a valve opening pressure-oil temperature characteristics of the oil jet 100 according to the present embodiment, and its longitudinal axis is the oil pressure and its horizontal axis is the oil temperature. According to the oil jet 100 of the present embodiment, the valve opening pressure is self-regulated mechanically so as to be lower with an increase in the oil temperature and so as to be higher with a decrease in the oil temperature, as shown in the graph. Note that, in the graph shown in FIG. 4, the operational range of the oil jet 100 is divided into four ranges according to the oil temperature and oil pressure. Hereinafter, the operation of the oil jet 100 in each operational range and the effects thereof will be described with reference to a table shown in FIG. 5.

The operational range (1) is a low-oil-temperature and low-oil-pressure range. This can be also said to be a low-oil-temperature and low-engine-speed range since the oil pressure changes in accordance with the engine speed. The oil viscosity is high at the time of low oil temperature, and therefore, the oil that has passed through the orifice 26 to flow into the differential pressure room 24 is hard to be leaked from the leak hole 28. Accordingly, the oil pressure in the differential pressure room 24 becomes high, and the valve opening pressure of the piston valve 16 becomes high. Hence, the piston valve 16 is not opened in a low engine speed range during which the oil pressure in the oil passage 42 is low, and no oil injection by the first oil injection nozzle 12 is performed. An internal combustion engine in the operational range (1) does not need cooling by the oil because the temperature of a piston in the internal combustion engine is low, instead a stopping of oil injection from the first oil injection nozzle 12 can prevent the piston from being excessively cooled.

The operational range (2) is a low-oil-temperature and high-oil-pressure range, that is to say, a low-oil-temperature and high-engine-speed range. A situation in which an internal combustion engine in a cold state is operated at high engine speed is included in this range, and the temperature of a piston rises to a level which needs cooling. According to the oil jet 100 of the present embodiment, in this operational range (2), the piston valve 16 is opened when the oil pressure in the oil passage 42 exceeds a valve opening pressure, and thereby, oil injection by the first oil injection nozzle 12 is performed. This allows a piston that has become high in temperature to effectively be cooled.

The operational range (3) is a high-oil-temperature and low-oil-pressure range, that is to say, a high-oil-temperature and low-engine-speed range. The oil viscosity is low at the time of high oil temperature, and therefore, the oil that has passed through the orifice 26 to flow into the differential pressure room 24 is easy to be leaked from the leak hole 28. Accordingly, the oil pressure in the differential pressure room 24 becomes low, and the valve opening pressure of the piston valve 16 becomes low. The piston valve 16, however, is not opened because the oil pressure in the oil passage 42 is also low in a low engine speed range, and no oil injection by the first oil injection nozzle 12 is performed. When an internal combustion engine is in the operational range (3), although the oil temperature is high, the temperature of a piston does not rise so much because the engine speed is low. Consequently, cooling of the piston by the oil is not needed, and a stopping of oil injection from the first oil injection nozzle 12 can prevent the piston from being excessively cooled instead.

The operational range (4) is a high-oil-temperature and high-oil-pressure range, that is to say, a high-oil-temperature and high-engine-speed range, in this operational range (4), the oil pressure in the oil passage 42 becomes high, whereas a valve opening pressure of the piston valve 16 becomes low because the oil becomes easy to be leaked from the leak hole 28 due to a decrease in oil viscosity. Because of this, the piston valve 16 is easily opened to perform oil injection by the first oil injection nozzle 12, and thereby, a piston that has become high in temperature is effectively cooled.

As described so far, the oil jet 100 according to the present embodiment can surely perform oil injection from the first oil injection nozzle 12 in operational ranges which need cooling of a piston of an internal combustion engine, and surely stop the oil injection in operational ranges which do not need cooling of the piston. Further, according to the oil jet 100 of the present embodiment, oil injection which is needed can be surely performed, even if a failure should occur, specifically, even if the spring 18 for moving the piston valve 16 should be broken. More specifically, since the spring 18 is biasing the piston valve 16 in a direction blocking the valve opening, a biasing force thereof disappears when the spring 18 has been broken, and thereby, the piston valve 16 is opened at a lower oil pressure. This allows oil injection for a piston to be surely performed, and therefore, an occurrence of troubles, such as seizure of the piston, due to a failure of the oil jet 100 is prevented.

Moreover, according to the oil jet 100 in the present embodiment, even in any of the operational ranges (1) to (4), oil injection is performed toward the cylinder bore from the second oil injection nozzle 30, although there is a difference in injection momentum due to the influences of the opening and closing of the piston valve 16 and the magnitude of viscosity of the oil. Therefore, the oil that is leaked outside from the leak hole 28, which is provided for ensuring that the valve opening pressure can be self-regulated mechanically in accordance with the oil temperature, can be effectively utilized for lubrication of the cylinder bore unlike a case of simply leaking.

As described above, it can be said that the oil jet 100 according to the present embodiment includes: the first oil injection nozzle 12 that is configured to inject oil to the back side of the piston of the internal combustion engine in an operational range in which cooling of the piston is required; and the second oil injection nozzle 30 that is configured to constantly inject oil to the cylinder bore.

Furthermore, as already described, in the oil jet 100, the leak hole 28 and the second oil injection nozzle 30 that is connected thereto are provided at the side surface of the cylinder 4. By this means, even when a foreign matter flows into the differential pressure room 24, the leak hole 28 can be prevented from being clogged by the foreign matter since the foreign matter moves to the bottom portion of the cylinder 4 due to the action of its own weight. Therefore, injection of the oil from the second oil injection nozzle 30 for the cylinder bore can be stably performed. In addition, an occurrence of trouble with respect to mechanical self-adjustment for the valve opening pressure due to the clogging of the leak hole 28 by a foreign matter can be prevented. As described above, according to the configuration of the present embodiment, the resistance to foreign matter can be improved by use of a simple configuration, without a need to install inside the oil jet 100 a member for removing a foreign matter, such as a filter.

Incidentally, in the first embodiment, which has been described above, the second oil injection nozzle 30 is included as a member to inject oil toward the cylinder bore. If, however, another portion that is other than the cylinder bore and that constantly requires an oil supply is present due to a reason such as that oil is more likely to run short, the distal end of the second oil injection nozzle according to the present invention may be directed with respect to such portion.

DESCRIPTION OF SYMBOLS

2 body
4 cylinder
6 oil supply port
8 plug
8*a* reference surface of plug
10 oil injection port
12 first oil injection nozzle
14 first oil injection passage
16 piston valve
18 spring
20 stopper
22 stepped portion
24 differential pressure room (closed compartment)
26 orifice
28 leak hole
30 second oil injection nozzle
32 second oil injection passage
40 cylinder block
42 oil passage
100 oil jet

The invention claimed is:

1. An oil jet, comprising:

a body having:

an oil supply port which opens into an oil passage in a cylinder block of an internal combustion engine, a cylinder having a first end which is communicated with the oil supply port, a second end which is closed, and a side surface extending between the first end and second end, and an oil injection port which opens on the side surface of the cylinder;

a piston valve that is accommodated in the cylinder and contacts a portion of the side surface of the cylinder between the oil supply port and the second end of the cylinder to form a compartment in the cylinder, and includes an orifice which makes the compartment being communicated with the oil supply port;

a spring that biases the piston valve toward a position at which the oil injection port is closed; and a first oil injection nozzle that is connected to the oil injection port and is fixing a direction of injection of oil, wherein a leak hole which allows oil to be leaked outside the cylinder from the compartment is open at the side surface of the cylinder, the leak hole being configured as a hole in which a flow rate is determined based on Hagen-Poiseuille law, and wherein the oil jet further comprises:

a stopper for limiting a moving range of the piston valve so that the leak hole is not covered by the piston valve; and a second injection nozzle that is connected to the leak hole and that is for fixing a direction of injection of oil.

2. The oil jet according to claim 1, wherein the second end of the cylinder that is closed is positioned at a lower side in a direction of gravitational force in the cylinder relative to a position of opening of the leak hole with respect to the cylinder.

3. The oil jet according to claim 1, wherein a distal end of the first oil injection nozzle is directed to a back side of a piston that reciprocates in a cylinder of the internal combustion engine, and wherein a distal end of the second oil injection nozzle is directed to a cylinder bore of the internal combustion engine.

* * * * *